United States Patent [19]

Peek

[11] Patent Number: 4,962,721

[45] Date of Patent: Oct. 16, 1990

[54] APPARATUS FOR COATING A CONTAINER WITH A LIQUID

[75] Inventor: William J. Peek, Lithonia, Ga.

[73] Assignee: Sewell Plastics Inc., Atlanta, Ga.

[21] Appl. No.: 281,403

[22] Filed: Dec. 8, 1988

[51] Int. Cl.[5] ..... B05C 1/02

[52] U.S. Cl. ..... 118/209; 118/218; 118/233; 118/239; 118/253; 118/264

[58] Field of Search ..... 118/200, 239, 264, 266, 118/267, 253, 209, 232, 233, 268, 270, 218; 427/429

[56] References Cited

U.S. PATENT DOCUMENTS

| | | | |
|---|---|---|---|
| 707,738 | 8/1902 | Warren | 156/566 |
| 1,449,342 | 3/1923 | Morrell | 118/253 |
| 2,095,038 | 10/1937 | Ragot | 427/429 |
| 3,133,309 | 5/1964 | Miles | 427/429 |
| 3,677,801 | 7/1971 | Hardy | 427/286 |
| 4,275,097 | 6/1981 | Shriver | 427/445 |
| 4,544,431 | 10/1985 | King | 156/566 |

FOREIGN PATENT DOCUMENTS

| | | | |
|---|---|---|---|
| 151782 | 10/1955 | Sweden | 118/264 |

*Primary Examiner*—Willard Hoag

*Attorney, Agent, or Firm*—Barnes & Thornburg

[57] ABSTRACT

An apparatus for applying a uniform liquid coating to selected portions of an outer surface of an object having a convex horizontal cross section and a constant vertical profile is disclosed. An application pad having a surface contoured to approximate the constant vertical profile of the object acts as a liquid reservoir. The object is transported in a rolling contact with the application surface sufficient to ensure uniform application of the liquid to the surface of the object without substantial deformation of the application pad surface. A support for maintaining the application pad in an orientation such that rolling contact with the surface of the object is provided. Liquid is supplied to the application pad in an amount sufficient to wet the application pad surface and uniformly dispense liquid to the outer surface of the object.

17 Claims, 1 Drawing Sheet

APPARATUS FOR COATING A CONTAINER WITH A LIQUID

BACKGROUND OF THE INVENTION

This invention relates to an apparatus and method for uniformly coating selected portions of a rotating container with a liquid by a direct physical application of the liquid.

Coating containers with various liquid substances is widely practiced in the container manufacturing industry. The applied coatings can be merely decorative paints, or necessary coatings such as opaque paints or lacquers that provide protection to container contents from photodegradation. Coating a container with resinous layers that upon curing protect the container from corrosion, or with preparative fluids such as anti-static coatings or primer base coats that enable other forms of processing to occur, is also a common practice in the industry.

One method of coating containers known in the prior art is spray coating. A sprayer, which can be either a pressurized mist type or pressureless type, is used to impart a liquid coating to a rotating container. However, these types of spray devices are unsuitable for many purposes. The liquid spray has a tendency to spread outside the desired coating area, consequently wasting expensive fluids, providing uneven coating thickness, and detrimentally coating areas of the container with a contaminating liquid.

The dispersion of a liquid coating to areas outside the intended area of coating is of particular concern to the food and beverage industry. The containers having an open end are particularly susceptible to contamination of the interior of the container from stray dispersion of an airborne spray. This type of spray contamination can adversely affect both the safety and taste of foods or beverages placed in the contaminated containers.

Various expensive and inadequate means of alleviating these problems have been used by the container manufacturing industry. Fume hoods or pressurized air flow can be used to draw or direct liquid mists away from areas of the container that do not need a coating of sprayed liquid material. Spray shields can be used to physically or electrostatically stop sprayed droplets from contacting an inappropriate area of the container. Recovery and purification methods also provide a way of reusing fluids spray deposited on the wrong surface. However, these methods can be expensive to implement and operate, limiting their extensive use with many types of containers.

One method of eliminating some of the problems associated with spray coatings has been to directly apply the coating to the container with a foam applicator attached to a revolving belt. A spongy foam is coated with the liquid substance during one point in its revolution, and applies the liquid coating to the object at a later point in the revolution. The method relies on the flexible nature of the foam, which can be differentially compressed to remain in conformable contact with an object to be coated. (See U.S. Pat. No. 3,677,801 issued July 18, 1972)

However, although the previous method allows the complete liquid coating of any container that does not have irregularities sufficient in magnitude to prevent conformable deformation of the foam layer to match the container irregularities, it does not adequately allow the application of a uniform coating to any container.

This method gives a liquid coating of non-uniform thickness because the spongy foam dispenses a varying amount of liquid to the surface of the object depending upon the changing compressive forces exerted by an irregular object against the foam. Furthermore, the method is not capable of selectively coating a selected portion of a container without using a complex system of multiple belts with associated mounted foams.

Another method of coating a container involves the use of a roller having a central axis of rotation parallel to the direction of the container movement. The roller is constructed of a dimensionally stable high grade steel with parallel striations or grooves inscribed in the roller. Each groove is capable of holding a certain amount of liquid that can be applied to a container passing over the rotating rod. The rod is partially immersed in a liquid bath to maintain a supply of liquid in the grooves. Application of the liquid occurs when the liquid contacts an aluminum can (See U.S. Pat. No. 4,275,097 issued June 23, 1981)

Although a uniform coat of liquid is applied to the container by the previous method, the cost in construction and maintenance of precision machinery is too high for many purposes. Expensive materials, precision machined to exacting requirements are needed for successful operation of this invention. The method also does not allow for the uniform coating of non-cylindrical containers, greatly limiting the potential use of the method.

It is accordingly an object of the present invention to provide a container coating apparatus capable of coating selected portions of a container with a liquid.

It is a further object of this invention to provide a container coating apparatus suitable for continuous industrial manufacturing operation, simple to operate and maintain and capable of being easily adapted for use with a variety of containers.

It is also an object of this invention to provide a container coating apparatus that does not significantly apply any liquid coating to areas that do not require or are adversely affected by the presence of a liquid coating, thereby limiting the amount of liquid necessary to coat an object and preserving the interior of the container from harmful contamination.

Another object of the invention is to provide a container coating apparatus that can uniformly apply a liquid coating of constant thickness to a container, thereby preventing an uneven or patchy coating of the container and also limiting the amount of liquid necessary to ensure a minimal thickness of the coating.

SUMMARY OF THE INVENTION

The present invention provides an apparatus and method for the application of a uniform liquid coating to selected portions of the outer surface of an object having a convex horizontal cross section and a constant vertical profile, such as are commonly employed as containers in the food and beverage industry. Decorative or protective paints, primer base coats, resinous liquids, and anti-static coatings are among the varieties of liquids that can be applied to a container by the apparatus and method of this invention.

The invention comprises a liquid application pad consisting essentially of a porous material capable of acting as a reservoir for the liquid to be applied. The application pad can be conceptually and practically divided into two parts, the first being the body of the application pad acting as a porous liquid reservoir that maintains a supply of liquid, and the second being the surface of the application pad. The application pad surface lightly contacts the object to be coated, and can transfer sufficient surficial liquid to the object to ensure a uniform coating of the object. The porous liquid reservoir formed from the body of the application pad is kept in fluid communication with the surface of the application pad, to ensure that an adequate supply of liquid to the application pad is maintained.

The application pad can be composed of a single material that is both porous and has a durable surface. Alternatively, the applicator can be constructed from a double layer of differing materials, with the innermost material selected for superior porosity and permeability properties that would enhance its ability to act as a liquid reservoir, and a thin outer surface layer selected from a durable material having a high permeability. For the purposes of this invention, a felted, reticulated, foamed polymeric material can be used. A particularly suitable material, open celled polyurethane foam, is available in a wide range of forms having various porosities, compressibilities and durability. A single type of polyurethane foam can be selected, or layers of differing types of polyurethane foam can be used for an application pad.

The surface of the application pad is permanently contoured to match the vertical profile of the object, which must have a convex horizontal cross section and a constant vertical profile. For the purposes of this invention, convex horizontal cross section means the orthogonal cross section of the object relative to the vertical axis of rotation of the container. A constant vertical profile can be defined as the surface profile of the container taken parallel to the vertical axis of container rotation. The distance of the surface from the vertical axis of rotation can vary if such change is smoothly continuous, but the vertical profile of the surface itself must remain invariant.

The liquid contained within and upon the surface of the application pad is applied to an object rotating about its vertical axis in rolling contact with the application pad. Although the object contacts the application pad, no substantial deformation of either the application pad or the object should occur during the rolling contact. One method of achieving this type of low compressibility rolling contact can be realized by having at least one rotating belt set substantially parallel to the surface of the application pad. The rotating belt is set at a distance from the application pad surface substantially equal to the diameter of the horizontal cross section of the object at the vertical height of the rotating belt. The rotating belt frictionally engages the surface of the object, and causes the object to rotate in rolling contact with the application pad surface. The lateral transport of the object along the application pad surface can also be enhanced by utilization of a conveyor belt system upon which the container is either gravitationally sited or attached in a manner permitting rotation about the vertical axis of the container.

The application pad is supported in an orientation that permits the rolling contact of an object. Generally, this means that the pad will be oriented substantially parallel to the vertical axis of rotation of the object. If the application pad is constructed from a material having high tensile strength and a rigid internal support, such as found in certain polyurethane foams, the support means can be a relatively light structure that simply maintains the position of the application pad. If the application pad material is not as strong as polyurethane foam, or if the application pad does not have sufficient thickness to remain rigid under stress, a metal or hard plastic backing support will generally be sufficient to ensure rigidity. A backing support material is also of value if the reservoir liquid is pressurized, ensuring that transport of the liquid is to the application pad surface, and not out of rear or side surfaces of the application pad. The support means can be further be constructed so that the application pad can be affixed at varying distances from the means for transporting the object. This allows coating of objects having varying sizes, and also ensures that the proper distance to ensure non-compressive rolling contact of the object with the application pad can be maintained.

A final element of the invention is a means for supplying a liquid to the application pad. For limited duration use this can be as simple as presoaking to saturation the liquid application pad. For continuous use a means of feeding a continuous supply of liquid to the liquid reservoir of the application pad, such as gravity feed or by a pressurized means, is necessary. In continuous operation, the amount of liquid fed to the application pad by liquid supplying means should be adjusted so that the amount of liquid entering the liquid reservoir of the application pad is equal to the amount leaving the surface of the application pad.

BRIEF DESCRIPTION OF THE DRAWINGS

Various features and advantages of the invention will become apparent to those skilled in the art upon consideration of the following detailed description of a preferred embodiment exemplifying the best mode of carrying out the invention as presently perceived. The detailed description particularly refers to the accompanying figures in which.

DETAILED DESCRIPTION OF THE INVENTION

Figure 1:
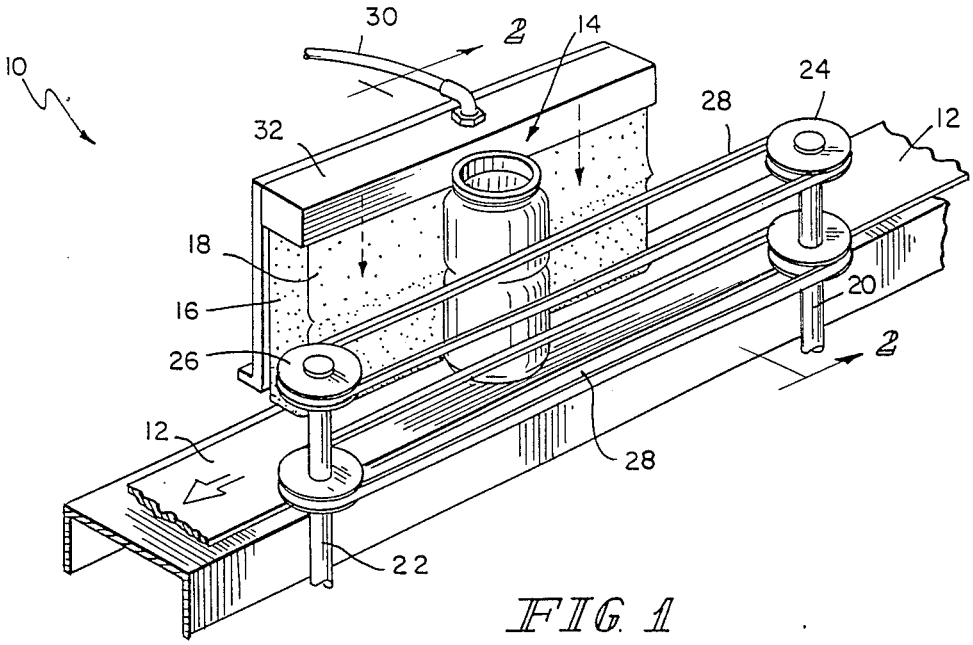
FIG. 1 is a perspective view of the invention, with a container being laterally transported by a conveyor belt in rolling contact with an application pad fed from a pressurized liquid source.

In the operation of a coating apparatus 10 as shown in FIG. 1, a container 14 moving along a conveyor belt 12 is placed in rolling contact with the application pad surface 18 of the application pad 12. The container 14 as shown in the figures is a typical representative of the open mouthed jars widely used in the food industry. Alternative containers or objects having a wide range of compositions can also be coated with a liquid by this invention.

Figure 2:
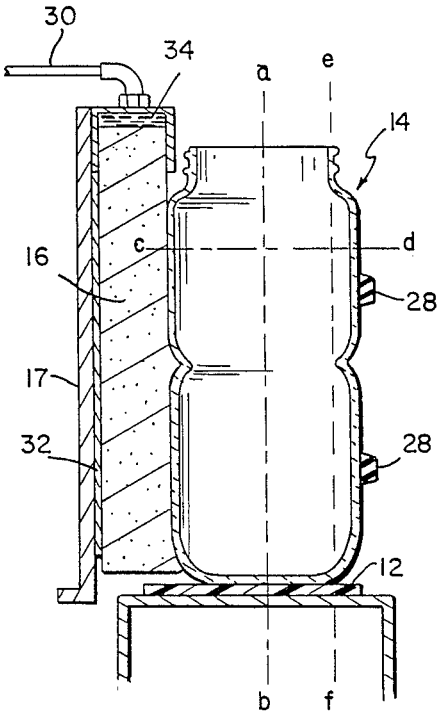
FIG. 2 is a side cross sectional view of the apparatus shown in FIG. 1 taken along line 2—2, showing a one piece application pad contoured to match the vertical profile of a container.

As shown in FIG. 2, the container 14 must have a central axis of rotation (line a–b) about which the vertical profile of the surface of the object is constant. A vertical profile of an object is constant if the following conditions are satisfied. In a plane parallel to the central axis (the plane defined by line a–b and line c–d) a line e–f is constructed parallel to the central axis a–b and intersecting the point on the container surface 15 closest to the central axis a–b. The orthogonal distance of each point on the container surface 15 to line e–f is then determined, thereby constructing a vertical profile of the surface of container 14. If all vertical profiles of the container 14 are determined to be identical, then the container 14 has a constant vertical profile. There is an additional constraint on the geometry of the vertical profile of the container 14. If the vertical profile is oriented horizontally on a Cartesian coordinate plane, the curve defining the vertical profile must be continuously differentiable along those areas to be coated with the liquid. This is necessary to ensure that a contoured application pad can be constructed to permit rolling contact with the container 14.

The container 14 must also have a convex horizontal plane cross section for the proper operation of the present invention. A horizontal plane cross section of the container 14 is taken orthogonal to the central axis of rotation a–b and must have an edge that describes a convex polygon or closed curve. In FIG. 2 a typical horizontal cross section could be the plane orthogonal to the central axis of rotation a–b containing the line c–d. This requirement is necessary because otherwise the concave portion of the horizontal cross section of an object could not be wetted by rolling contact with the container 14 and the non-flexible application pad surface 18.

Objects that satisfy the previous geometrical constraints and have a surface material capable of accepting the liquid can be coated using the present apparatus and method. Open or closed cylindrical tubes, spheres, ellipsoids and many standard food and beverage containers can all be coated with a uniform layer of liquid. As a result of the container geometry, excessive or deficient application of a liquid to a container 14 is not encountered because there is little or no fluctuation in the compressive forces exerted against the application pad surface 18 as the container 14 laterally rotates along the application pad surface 18.

The application pad 18 consists generally of an open cell foam with desired permeability, porosity, physical strength, abrasion and solvent resistant qualities. The foam is sculpted or produced with a surface having a vertical profile that can conformably engage with surface of container 14. The compressibility of preferred embodiments of the foam should be low, with a 25% compression load deflection on a 0.25 inch thick sample greater than about 3 psi. There is no upper limit for the compression load deflection of a foam material, provided that the foam retains sufficient permeability to allow application of the desired liquid. However, foam materials having a compression load deflection much lower than 3 psi for a 25% compression load deflection of 0.25 inch thick foam material are too highly compressible for use as an application pad. Such a spongy, highly compressible foam is differentially compressed by a container 14 when placed in revolving contact, thereby squeezing out excess liquid to certain areas of the container 14, and providing deficient application of liquid in other areas of the container. The non-uniform, spotty liquid coating applied by such a spongy, highly compressible foam material is unsuitable for use as an application pad.

The application pad 16 must have a porosity and permeability to permit the liquid to flow to the surface 18 is sufficient quantity to apply the minimum desired amount of liquid to the container 14. Generally, the permeability of the pad must be between about 10 and 200 cfm/ft$^2$ (measured at a pressure of 0.5 in. $H_2O$ on sample of $\frac{1}{8}$ in. thickness) to meet expected commercial preventing any undue line through put rates while still gravitational skewing of the amount of liquid deposited on the container surface. If the permeability of the pad 16 is too little, an insufficient amount of liquid is delivered to the surface 18. If the permeability of the pad is too great, more liquid is delivered to the bottom portion of the container 14 than to the top of the container due to a gravitational influence on the liquid in the pad. The preferred permeability of the pad 16 is about 50 cfm/ft$^2$ @ 0.5 in. $H_2O$ on $\frac{1}{8}$ in. thick sample.

Figure 3:
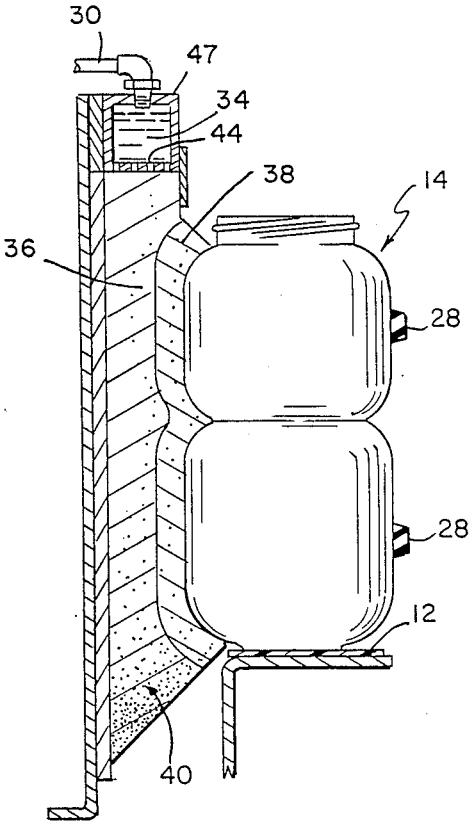
FIG. 3 is a side cross sectional view of the apparatus similar to that of FIG. 2, showing a two piece application pad with a high porosity foam acting as a primary liquid reservoir, and a thinner, durable outer layer contacting the object.

If adjustments in the pemeability of pad 16 are insufficient to prevent pooling of liquid at the bottom of the pad, a structural solution is available to prevent over application of liquid to the lower side surfaces of container 14. As shown in FIG. 3, a pool storage means 40 can be formed by extending application pad 16 below the level of container 14. Excess liquid will pool in this area, and an abnormally thick liquid coating will not be imported to the lower side surfaces of container 14.

A preferred material of the pad 18 consists essentially of a reticulated, felted, open cell polyurethane foam with superior permeability, porosity, physical strength, abrasion and solvent resistant qualities. In the most preferred embodiment a compressed flexible polyester polyurethane foam having a tradename of 6-900Z Scottfelt is used. This is a reticulated felted foam with a compression ratio of 6:1 (as measured relative to a standard grade 900 Scottfelt made from 90 pores-per-linear inch reticulated foam with 97% void volume before felting). The foam has a 25% compression load deflection of about 6 psi, making it well suited for low compressibility applications. The foam also has a void volume of 82%, and can absorb light oil to 73% by volume, or 0.64 grams/cubic-centimeter. A $\frac{1}{4}$ inch thick foam block has a measured tensile strength of 150–175 psi, which minimizes the need for a sturdy backing support in the apparatus. The permeability of the foam is 43 cfm/ft$^2$ at a 0.5 inch water pressure differential as measured with a Frazier high pressure permeability tester. The foam has the additional advantage of acting as a filter, trapping particle contaminants in the liquid as small as 35 microns in size.

The physical properties of the 6-900Z Scottfelt are advantageous for the operation of the present invention, but alternative foams may also be used. Polyurethane foams having greater or lesser compressibility, porosity, permeability, and abrasion resistance are also commercially available and can be feasibly used in this invention. For example, if a pressurized liquid feed is used to supply the liquid pad, an extremely porous foam capable of acting as a long term liquid reservoir is not necessary for the operation of the invention. A foam having a high permeability that allows flow of the pressurized liquid and greater abrasion resistance could be used to lengthen the effective lifetime of the application pad. Alternatively, multiple foam layers can be used to take advantage of specific foam properties. As shown in FIG. 3, an abrasion resistant, durable surface layer 38 that has a low porosity unsuitable for acting as a liquid reservoir could be backed by a porous liquid reservoir layer 36 which is too soft and compressible to form the required contoured surface. In this manner, the requirements of low compressibility combined with liquid transfer ability are satisfied, enabling uniform liquid coating of an object.

The application pad 18 is supported in position by a support means 17. The support means 17 is firmly attached to the application pad 16 and can optionally be permanently affixed at the correct position for providing a uniform coating to a container having a certain selected size. However, more flexibility is gained by providing for a movable attachment of the support means 17, which allows the processing of containers of various sizes that have identical vertical profiles. A fine movement control can also be added to enable more precise adjustment of the support means 17 position.

A preferred embodiment of the support means 17 consists of a substantially flat metal backing equipped with clamping means to retain the foam in position. However, as those skilled in the art can appreciate, a wide variety of means can be used to rigidly fix a substantially flat piece of foam in a given orientation.

The container 14 is kept in a rolling contact with the application pad 18 by a belt 28, revolving about a drive pulley 24 fixed to a drive rod 20 and a free pulley 26, rotatably mounted on fixed rod 22. The horizontal length of belt 28 can be determined so that single or multiple revolutions of the container 14 are encouraged, allowing placement of a desired coating thickness on the surface of container 14. Alternative embodiments of ensuring rolling contact may also be used. For example, rotatably mounting the container on a spindle attached to a moving conveyor belt would act to ensure rotation of a container 14 upon contact with a fixed application pad surface 18. Other means of causing rotation of a container relative to an application pad surface can be readily contemplated by those skilled in the art.

For single or limited duration use, the application pad 16 can be soaked in a pool of liquid until saturated, then brought into the correct orientation for operation of the invention. If long duration or continuous use of the apparatus is desired, a means of continuously supplying liquid to the application pad 16 is necessary. Because of the wicking ability of the contemplated foam materials, a partial immersion of a lower edge of the application pad 16 in a liquid bath could act to supply a sufficient amount of liquid to the application pad surface 18, especially in light duty applications. If higher liquid application rates are desired, at least partially surrounding the application pad 16 with an impervious cladding 32 shown in FIG. 1 and FIG. 2 allows a gravity or pressure fed means of supplying liquid through a liquid conduit 30 to the application pad 16. The impervious cladding 32 prevents blowout of the liquid from the application pad 16 and contains freshly supplied liquid until the liquid is absorbed by the application pad 16. As those skilled in the art may appreciate, the amount of liquid fed to the application pad 16 through liquid conduit 30 can be controlled and regulated by appropriate valving means.

Alternatively, as shown in FIG. 3, an enclosed reservoir 42 can be used to release liquid 34 through perforations 44 into the porous liquid reservoir layer 36. The liquid 30 can be either pressurized or unpressurized, depending on the amount and rate of coating desired in the operation of the invention.

It is contemplated that the previously described apparatus and method will have diverse embodiments adapted for particular uses or environments. The particular embodiments previously described are not intended to limit the scope of the invention, and it is intended that the following claims will encompass alternative and equivalent embodiments of the invention.

I claim as my invention:

1. An apparatus for applying a uniform liquid coating to selected portions of an outer surface of an object having a convex horizontal cross section and a constant vertical profile comprising:

an application pad acting as a liquid reservoir means and further having an application surface contoured to mirror a vertical profile of an object with a convex horizontal cross section and a constant vertical profile, the application pad having a lower portion extending below the application surface to form a pool storage means for containing excess liquid;

transporting means for transporting the object above the application pad lower portion in a rolling contact with the application surface sufficient to ensure uniform application of the liquid to the surface of the object without substantial deformation of the application pad surface;

a support means for maintaining the application pad in an orientation such that rolling contact with the surface of the object is maintained; and means for supplying a liquid to the application pad, said liquid being supplied in an amount sufficient to wet the application surface of the application pad and uniformly dispense liquid to the outer surface of the object.

2. The apparatus of claim 1 wherein the means for supplying a liquid comprises a liquid reservoir in fluid communication with the application pad through a liquid conduit means.

3. The apparatus of claim 1 wherein the means for supplying a liquid comprises a liquid conduit means and a pressurized liquid reservoir in fluid communication with the application pad through the liquid conduit means.

4. The apparatus of claim 1 wherein the support means includes means for varying the distance of the support means from the transporting means, thereby allowing changes in the strength of the compression of the application pad by the object.

5. The apparatus of claim 1 wherein the means for transporting an object in rolling contact with the application pad surface comprises at least one rotating belt, oriented so that the rotating belt rotates substantially parallel to the application pad surface at a distance sufficient to ensure that a convex object has simultaneous contact with both the application pad surface and the rotating belt, thereby causing frictionally medicated rotation of the object having a convex horizontal cross section and a constant vertical profile along the application pad surface.

6. The apparatus of claim 1 wherein the application pad consists essentially of a felted, reticulated, foamed polymeric material.

7. The apparatus of claim 6 wherein said foamed polymeric material consists essentially of an open cell polyurethane foam.

8. The apparatus of claim 7 wherein said open cell polyurethane foam has a 25% compression load deflection of more than about 3 psi, when measured on a 0.25 inch thick sample.

9. An apparatus for applying a uniform liquid coating to selected portions of an object having a convex horizontal cross section and a constant vertical profile such a bottle, container, or the like comprising:

an open cell polyurethane foam application pad having a low compressibility and a coating surface contoured to match the vertical profile of an object having a convex horizontal cross section and a constant vertical profile, said application pad having sufficient thickness to act as a reservoir pad for the liquid and a lower portion extending below the coating surface to form a pool storage means for containing excess liquid;

means for transporting the object having a convex horizontal cross section and a constant vertical profile above the application pad lower portion in rolling contact with the application surface sufficient to ensure uniform application of the liquid to the surface of the object having a convex horizontal cross section and a constant vertical profile without substantial deformation of the application pad surface comprising at least one rotating belt, oriented so that the rotating belt rotates substantially parallel to the application pad surface at a distance sufficient to ensure that a convex object has simultaneous contact with the both the application pad surface and the rotating belt, thereby causing frictionally mediated rotation of the object having a convex horizontal cross section and a constant vertical profile along the application pad surface;

a support means for maintaining the application pad in an orientation such that rolling contact with the surface of the object having a convex horizontal cross section and a constant vertical profile is maintained; and means for supplying a liquid, said liquid being supplied in an amount sufficient to wet the application pad surface of the application pad and uniformly dispense a predetermined amount of liquid to the outer surface of an object having a convex horizontal cross section and a constant vertical profile, comprising a pressurized liquid reservoir in fluid communication with the application pad through a liquid conduct means, thereby increasing the liquid flow rate through the application pad and permitting an increased object coating rate.

10. Apparatus for applying a liquid coating to a container having a top, a bottom, and a non-linear sidewall joining the top to the bottom, the coating to be applied to at least a selected portion of the sidewall, the apparatus comprising:

a permeable, porous pad supported on a pad support, the pad having a contoured surface mirroring a vertical profile of a selected portion of a container sidewall, the pad having a 25% compression load deflection on a 0.25 in. thick sample of greater than 3 psi.;

means for transporting containers contiguous to and in rolling contact with the pad such that the contoured surface of the pad contacts only a vertical profile of the selected portion of the container sidewall; and means for supplying liquid to an upper surface of the pad in an amount sufficient to wet the pad and dispense a desired amount of the liquid on the surface of bottles contacting the pad.

11. The apparatus of claim 10 wherein the means for supplying liquid to the pad comprises a liquid reservoir situated above the pad and conduit means for delivering liquid from the reservoir to the pad upper surface.

12. The apparatus of claim 11 further comprising pump means for delivering liquid from the reservoir means to the pad upper surface.

13. The apparatus of claim 10 wherein the pad consists essentially of a felted, reticulated, foamed polymeric material having a void volume of at least 50%.

14. The apparatus of claim 13 wherein the polymeric material consists essentially of an open cell polyurethane foam having a permeability of between about 10 and 200 cfm/ft$^2$ @a pressure of 0.5 in. $H_2O$ on a $\frac{1}{8}$ in. thick sample.

15. An apparatus for applying a uniform liquid coating to selected portions of an outer surface of an object having a convex horizontal cross section and a constant vertical profile comprising:

transporting means for transporting a series of objects with a convex horizontal cross section and a constant vertical profile along a path having a lowermost extremity at a fixed height while rotating each of the objects about a vertical axis thereof;

an application pad situated adjacent to the transporting means having an application surface contoured to mirror at least a portion of the vertical profile of the series of objects and a lower portion extending below the application surface and situated below said lowermost extremity;

supply means for supplying liquid to the application pad, said liquid being supplied in an amount sufficient to wet the application surface of the application pad; and a support means for positioning the application pad such that rolling contact with said portion of the objects is sufficient to ensure uniform application of the liquid to the series of objects without substantial deformation of the pad application surface.

16. The apparatus of claim 15 wherein the supply means comprises a liquid reservoir in fluid communication with the application pad through a liquid conduit means.

17. The apparatus of claim 15 wherein the transporting means comprises a conveyor belt moving along said path and defining said lowermost extremity, and at least one rotation-causing belt situated above the conveyor belt substantially parallel to the application pad surface at a distance established by the support means which is sufficient to ensure that the series of objects has simultaneous contact with both the application pad surface and the rotation-causing belt for causing frictionally mediated rotation of the series of objects along the application pad surface.

* * * * *